US007077288B2

(12) United States Patent
McMillen

(10) Patent No.: US 7,077,288 B2
(45) Date of Patent: Jul. 18, 2006

(54) NEWSPAPER VENDING MACHINE

(76) Inventor: Russell G McMillen, 919 Winchester La., Fort Wayne, IN (US) 46819

( * ) Notice: Subject to any disclaimer, the term of this patent is extended or adjusted under 35 U.S.C. 154(b) by 297 days.

(21) Appl. No.: 10/655,770

(22) Filed: Sep. 5, 2003

(65) Prior Publication Data

US 2004/0245277 A1 Dec. 9, 2004

Related U.S. Application Data

(60) Provisional application No. 60/476,764, filed on Jun. 6, 2003.

(51) Int. Cl.
*B65H 3/00* (2006.01)

(52) U.S. Cl. ..... 221/194; 21/289

(58) Field of Classification Search ..... 221/194, 221/289, 191

See application file for complete search history.

(56) References Cited

U.S. PATENT DOCUMENTS

| | | | | |
|---|---|---|---|---|
| 388,369 | A | 8/1888 | Morse et al. | |
| 4,299,335 | A | 11/1981 | Ostermann | |
| 4,312,461 | A | 1/1982 | Godley, Sr. | |
| 4,365,701 | A | 12/1982 | Armstrong et al. | |
| 4,389,000 | A | 6/1983 | Godley et al. | |
| 4,448,328 | A * | 5/1984 | Wingate | 221/13 |
| 4,496,074 | A | 1/1985 | Owens | |
| 4,506,800 | A | 3/1985 | Wingate | 221/6 |
| 4,654,513 | A | 3/1987 | Hennessy | |
| 5,709,315 | A | 1/1998 | Kahler et al. | 221/155 |
| 5,791,511 | A * | 8/1998 | Lowing | 221/6 |
| 6,003,725 | A | 12/1999 | Blankenau et al. | |
| 6,112,941 | A | 9/2000 | Wenner | |
| 6,230,932 | B1 | 5/2001 | Lowing et al. | |
| 6,439,425 | B1 | 8/2002 | Masek | |
| 2004/0104239 | A1 * | 6/2004 | Black et al. | 221/124 |

* cited by examiner

*Primary Examiner*—Kenneth Noland
(74) *Attorney, Agent, or Firm*—Baker & Daniels

(57) ABSTRACT

The present invention provides a vending machine of the single vend type for dispensing newspapers, magazines, or other items. The machine generally includes a housing having a discharge opening, and a storage area having an inclined surface upon which a plurality of articles are stacked. A movable gate adjacent the storage area retains the articles therewithin. Upon insertion of a proper coin total into the machine, a drive device moves the gate downwardly until an uppermost article in the stack passes through the gate and is dispensed. The dispensed article, upon passing through the gate, actuates a switch to cause the drive device to reverse and move the gate upwardly a distance above the uppermost article in the stack, such that even if the machine is shaken, jostled, or tilted, the uppermost article in the stack is retained by the gate. The machine is also automatically sensitive to variations in thickness of the articles, as the switch controls operation of the gate responsive to the actual dispensing of an article.

23 Claims, 11 Drawing Sheets

NEWSPAPER VENDING MACHINE

CROSS REFERENCE TO RELATED APPLICATIONS

This application claims the benefit under Title 35, U.S.C. § 119(e) of U.S. Provisional Patent Application Ser. No. 60/476,764, entitled NEWSPAPER VENDING MACHINE, filed on Jun. 6, 2003.

BACKGROUND OF THE INVENTION

1. Field of the Invention

The present invention relates a single vend machine for dispensing newspapers, magazines, other printed matter, packaged products, or other items.

2. Description of the Related Art

Known newspaper vending machines typically include a bin for storing a stack of newspapers, and a door for closing the bin which is normally locked by a mechanical locking mechanism. The machines includes a coin acceptor which, upon acceptance of a proper inserted coin total, unlocks the locking mechanism of the door, allowing a purchaser to open the door and gain access to the newspapers within the bin. Problematically, the purchaser has access to the entire stack of newspapers within the machine upon opening the door. Although most purchasers desire only a single newspaper and therefore only remove one newspaper from the bin, it has been found that theft of newspapers from these types of newspaper vending machines is problematic. In particular, it has been suggested by some studies that theft from these types of newspaper vending machines is as high as from 25% to 27% of the total newspaper inventory which is sold using such machines. In some locations, theft from these types of newspaper vending machines is great enough that the machines cannot economically be used.

Responsive to the foregoing problem, many types of single vend machines have been developed which are operable to dispense only a single newspaper to a purchaser. However, many types of single vend machines require direct AC power connections, such that the machines cannot be used in remote locations where power is inaccessible, such as upon street corners, for example.

Additionally, many known single vend machines include complex mechanical vending mechanisms which are prone to malfunction or jamming, for example, such that the machines may fail to vend a newspaper after a proper coin total is inserted into the coin acceptor of the machine, which understandably causes frustration for purchasers. Such machines often require substantial repair and maintenance, and are therefore not effective to dispense newspapers economically.

One known single vend machine includes a housing in which a stack of newspapers are stored, the newspapers stacked upon an inclined surface. In response to insertion of a proper coin total into the coin acceptor of the machine by a purchaser, a panel disposed in front of the stack of newspapers moves downwardly a predetermined increment of travel, allowing the topmost newspaper in the stack to slide over the panel toward a discharge opening in the front of the cabinet.

Although these types of single vend machines are somewhat effective, they suffer from at least two major drawbacks. First, because the panel in front of the stack of newspapers moves downwardly only through a selected, predetermined increment of travel, the machine cannot easily be configured to dispense newspapers of varying thickness. As will be apparent to one of ordinary skill, newspapers are often printed with varying thickness throughout a given week, with Monday through Friday editions usually having a reduced thickness in comparison with Sunday editions. Further, special editions of newspapers may be produced from time to time which, due to increased news content, inserts, advertisement, etc., have a substantially increased thickness in comparison to regular editions. Depending upon the thickness of the newspapers, these types of machines may fail to dispense a newspaper upon receipt of a proper coin total, or may dispense more than one newspaper upon receipt of a proper coin total for a single newspaper.

Additionally, and again because the panel in front of the newspaper stack moves only through a predetermined increment of travel, after an uppermost newspaper in the stack has been dispensed, the next newspaper in the stack is often disposed very close to the upper edge of the panel. If the machine is thereafter shaken or tilted, this newspaper will often fall over the upper edge of the panel and into the discharge chute without a proper coin total being inserted into the machine. Thereafter, if a subsequent bona-fide purchaser inserts a proper coin total into the machine, the panel will not move downwardly to an extent necessary to dispense a further newspaper.

What is needed is a single vend newspaper vending machine which is an improvement over the foregoing.

SUMMARY OF THE INVENTION

The present invention provides a vending machine of the single vend type for dispensing newspapers, magazines, or other items. The machine generally includes a housing having a discharge opening, and a storage area having an inclined surface upon which a plurality of articles are stacked. A movable gate adjacent the storage area retains the articles therewithin. Upon insertion of a proper coin total into the machine, a drive device moves the gate downwardly until an uppermost article in the stack passes through the gate and is dispensed. The dispensed article, upon passing through the gate, actuates a switch to cause the drive device to reverse and move the gate upwardly a distance above the uppermost article in the stack, such that even if the machine is shaken, jostled, or tilted, the uppermost article in the stack is retained by the gate. The machine is also automatically sensitive to variations in thickness of the articles, as the switch controls operation of the gate responsive to the actual dispensing of an article.

In particular, in the context of vending newspapers, the present vending machine includes a housing having a front wall with a discharge or vending opening therein, and a storage bin within the housing in which a stack of newspapers are stacked upon a surface which is inclined with respect to the front wall. A gate is disposed facewise adjacent the storage area, and includes a discharge portion dimensioned such that an article may pass by gravity therethrough. An electric motor is drivingly coupled to the gate, and is operable in forward and reverse directions to lower and raise the gate, respectively.

Upon insertion of a proper coin total into a coin acceptor of the machine, a controller initiates operation of the motor in the forward direction to lower the gate. After the gate lowers a sufficient distance for an uppermost newspaper in the stack to pass through the gate, a switch in the gate is actuated by the newspaper to initiate movement of the motor in the reverse direction to raise the gate a predetermined distance such that the discharge portion of the gate is disposed above the next uppermost newspaper in the stack.

Therefore, even if the machine is shaken, jostled, or tilted, the uppermost newspaper in the stack will not pass through the discharge portion of the gate, such that the machine is resistant to unauthorized tampering. Additionally, because the switch in the gate is responsive to the actual passing of a newspaper through the gate before the motor reverses direction and raises the gate, the gate is sensitive to the particular thickness of the newspaper. In this manner, even if the thickness of the newspapers vary from time to time, calibration of the machine responsive to varying newspaper thickness is not necessary. The present vending machine is therefore theft and tamper resistant and is reliably operable to dispense only a single newspaper at a time responsive to a proper coin total being inserted into the machine.

The front wall of the machine includes a display area in which a single display newspaper is retained by a trap door pivotally attached to the front wall behind the display area. A switch is responsive to a lowermost extent of travel of the gate, which corresponds to an absence of newspapers in the storage area, to actuate a solenoid which opens the trap door to release and vend the display newspaper. After the display newspaper is released, a message such as "empty" is visible in the display area to inform potential purchasers that the newspaper inventory of the machine has been temporarily exhausted.

Additionally, the gate may include one or more spring arms which extend at least partially into the storage area to contact and retain an uppermost newspaper in the newspaper stack. Upon lowering of the gate in the dispensing operation, the spring arms are operable to disengage from the uppermost newspaper and engage a next uppermost newspaper in the stack, thereby allowing the uppermost newspaper to pass through the discharge portion of the gate while retaining the next lower newspaper in the stack and prevent same from also passing through the discharge portion of the gate. In this manner, the spring arms provide a positive retention feature which prevents the dispensing of more than one newspaper at a time.

In one form thereof, the present invention provides a vending machine, including a housing having a discharge opening therein; a storage area within the housing, the storage area having an inclined surface upon which a plurality of articles may be stacked, the storage area in dispensing communication with the discharge opening; a gate disposed adjacent the storage area, the gate movable bi-directionally with respect to the storage area; a bi-directional drive device drivingly coupled to the gate; whereby when the drive device is initially operable to move the gate in a first direction an article may pass the gate from the storage area toward the discharge opening, and when the drive device is subsequently operable to move the gate in a second direction opposite the first direction additional articles may not pass the gate; and a drive device reverse actuation switch associated with the gate, the switch responsive to an article passing the gate; whereby when the switch is actuated by a passing article, the drive device is caused to move the gate in the second direction.

In a further form thereof, the present invention provides a vending machine, including a housing having a wall with a discharge opening therein; a storage area within the housing, the storage area having a bottom surface with a stack of articles thereon, the bottom surface inclined in an upward direction from the wall; a gate disposed adjacent the storage area and having a discharge portion dimensioned for passage of an article therethrough, the gate movable downwardly and upwardly with respect to the storage area; a motor drivingly coupled to the gate, the motor initially operable in a forward direction to move the gate downwardly to align the discharge portion with an uppermost article in the stack, the motor subsequently operable in a reverse direction to move the gate upwardly such that the discharge portion is not aligned with any remaining articles in the stack; and a switch associated with the discharge portion of the gate, the switch responsive to an article passing the discharge portion to initiate operation of the motor in the reverse direction; whereby when the discharge portion is aligned with the uppermost article in the stack, the uppermost article may pass through the discharge portion toward the discharge opening and actuate the switch, and when the discharge portion is not aligned with any remaining articles in the stack, the remaining articles are prevented from passing the discharge portion.

In a still further form thereof, the present invention provides a vending machine, including a housing having a wall with a discharge opening therein; a storage area within the housing, the storage area having a bottom surface upon which a plurality of articles may be stacked, the bottom surface inclined upwardly with respect to the discharge opening; a gate disposed adjacent the storage area, the gate movable vertically with respect to the storage area; a drive device coupled to the gate and operable to lower the gate such that an article may pass the gate toward the discharge opening, and further operable to raise the gate such that articles are prevented from passing the gate; user-responsive means for initially causing the drive device to lower the gate sufficiently to allow an article to pass the gate toward the discharge opening; and article-responsive means associated with the gate for subsequently causing the drive device to raise the gate sufficiently to prevent further articles from passing the gate.

BRIEF DESCRIPTION OF THE DRAWINGS

The above-mentioned and other features and advantages of this invention, and the manner of attaining them, will become more apparent and the invention itself will be better understood by reference to the following description of an embodiment of the invention taken in conjunction with the accompanying drawings, wherein.

Corresponding reference characters indicate corresponding parts throughout the several views. The exemplification set out herein illustrates one preferred embodiment of the invention, in one form, and such exemplification is not to be construed as limiting the scope of the invention any manner.

DETAILED DESCRIPTION

Figure 1:
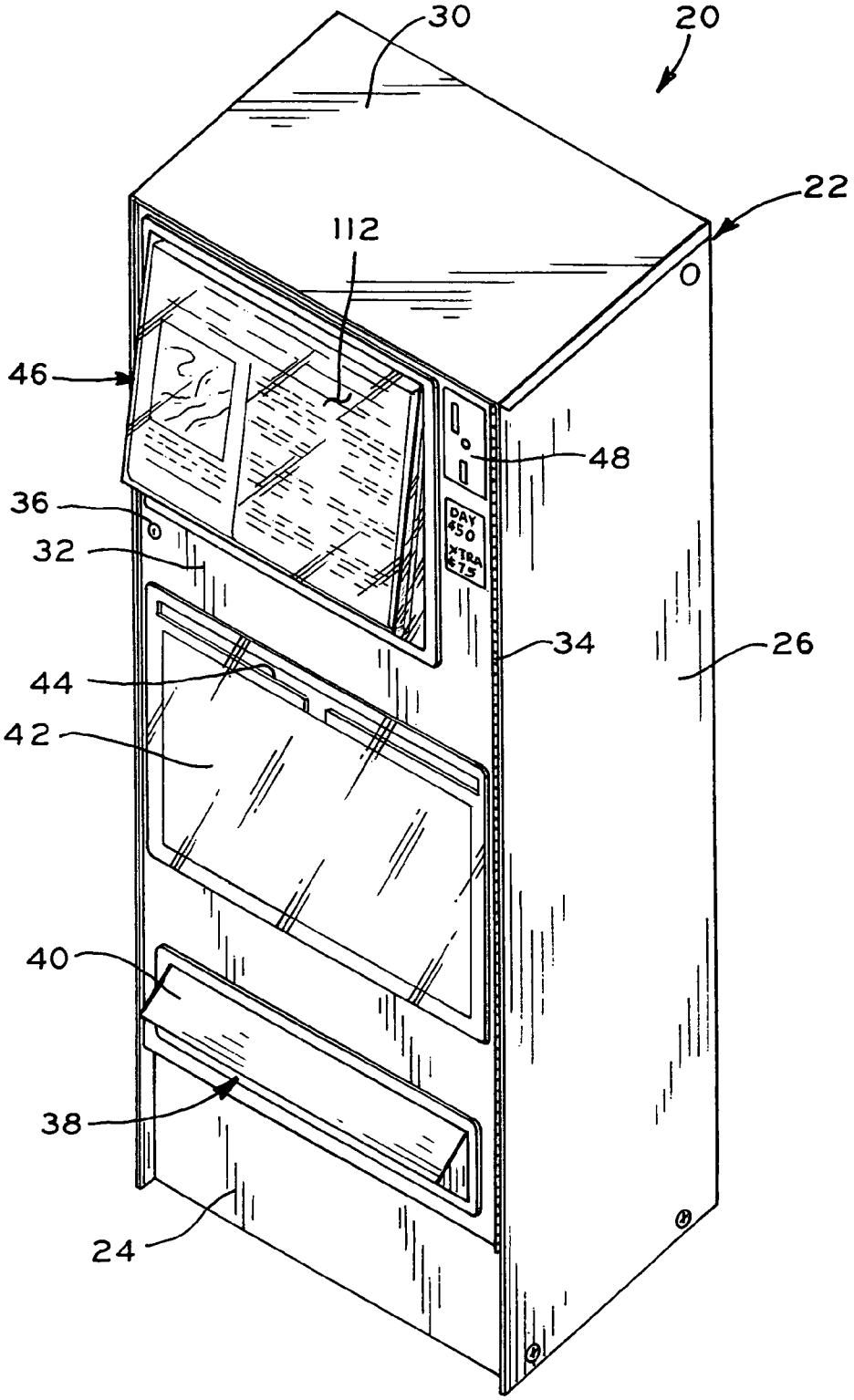
FIG. 1 is a front perspective view of a vending machine in accordance with the present invention.
Figure 4:
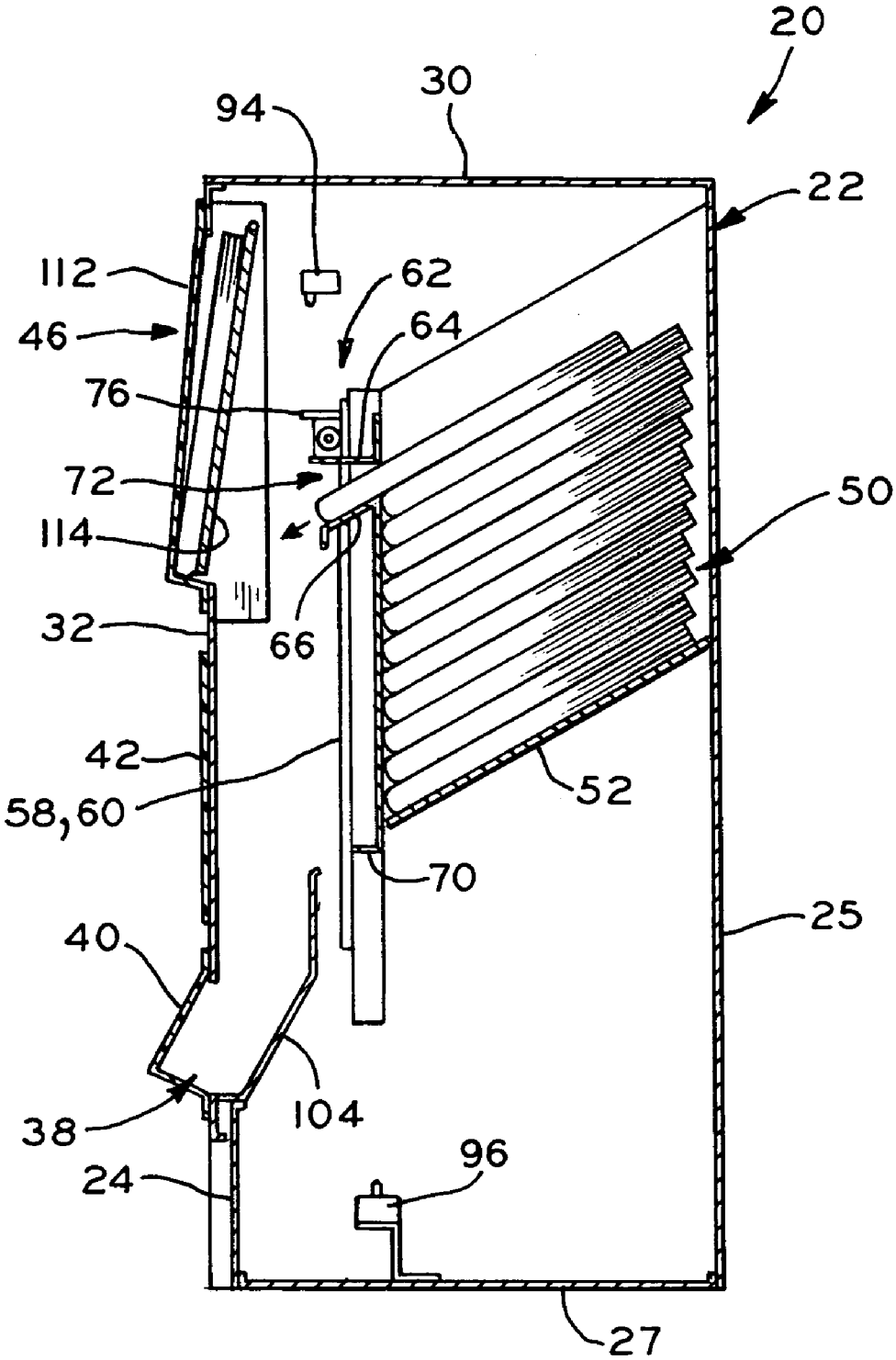
FIG. 4 is a side view of the machine.

Referring to FIG. 1, vending machine 20 is shown, which is described herein as a newspaper vending machine. However, in addition to newspapers, vending machine 20 may also dispense magazines, books, other printed matter, or small packaged items. Vending machine 20 generally includes housing 22 having front wall 24, side walls 26 and 28, top wall 30, and rear and bottom walls 25 and 27 (FIG. 4), respectively. Door 32 is hingedly attached to sidewall 28 by piano hinge 34 or another suitable hinge, and is locked in the closed position shown in FIG. 1 by a typical key-operated locking mechanism including keyhole 36.

Door 32 includes a horizontally elongated rectangular discharge opening 38 therein, with cover 40 attached to door 32 above discharge opening 38. Cover 40 protects discharge opening 38 from rain, snow, etc, and may also be pivotally mounted to door 32, wherein cover 40 is lifted to gain access to discharge opening 38 to remove a dispensed newspaper from machine 20. Cover 40 may be made of a semi-transparent or transparent plastic material, for example, to enable a purchaser to view a dispensed newspaper therethrough. Door 32 additionally includes a semi-transparent or transparent plastic advertising cover 42 defining advertising slot or pocket 44 between cover 42 and door 32 into which a printed advertisement may be inserted. Display area 46 is disposed in the upper portion of door 32 for displaying a display newspaper therein, as described in further detail below. Door 32 also includes coin acceptor module 48 mounted therein.

Figure 2:
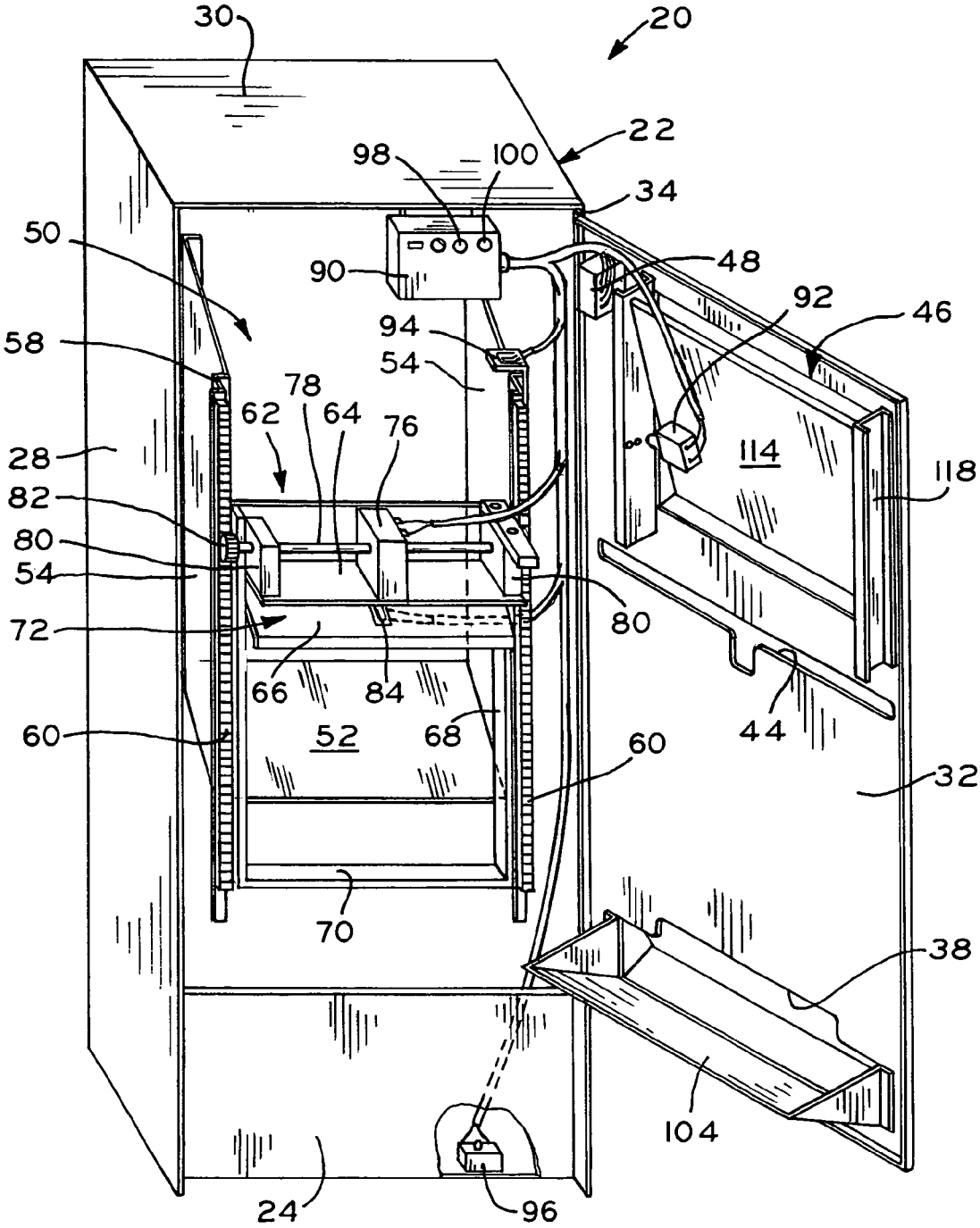
FIG. 2 is a front perspective view of the machine of FIG. 1, showing the door in an open position such that internal components of the machine are visible.
Figure 3:
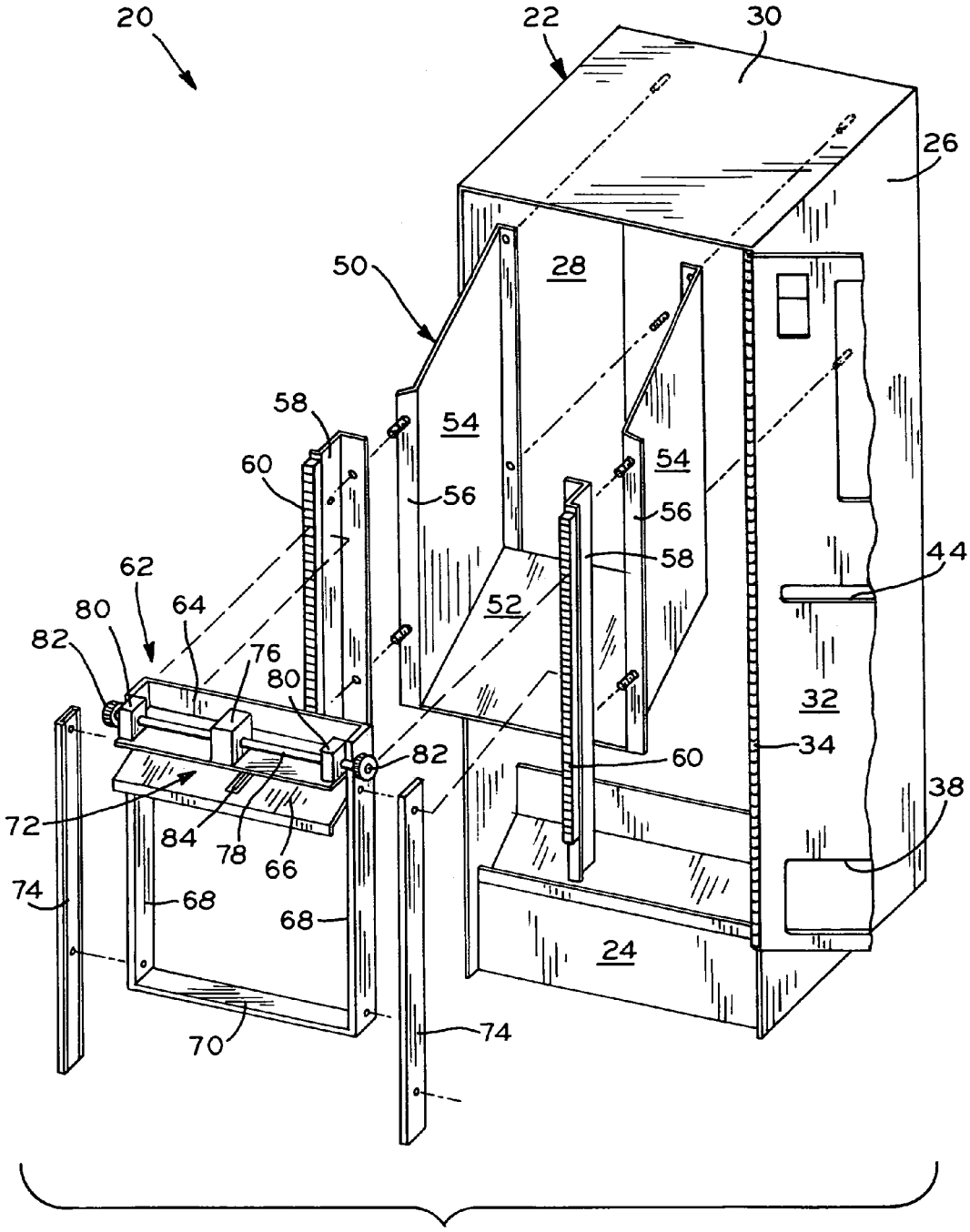
FIG. 3, is a perspective exploded view of some of the internal components of the machine, including the storage bin and gate.

Referring now to FIGS. 2 and 3, housing 22 including storage bin 50 mounted therein, which includes bottom wall 52 and side walls 54 which a storage area in which a stack of newspapers may be stored. Bottom wall 52 of bin 50 is inclined upwardly with respect to door 32 and discharge opening 38. Sidewalls 54 of bin 50 include flanges 56 upon which rails 58 are mounted, with rails 58 each including a vertical rack 60.

Gate 62 includes a frame defined by upper member 64, cross plate 66, side members 68, and bottom member 70. Upper member 64 and cross plate 66 define discharge portion 72 of gate 62 therebetween, which is dimensioned to allow passage of newspapers therethrough. Slides 74 are connected between side members 68 of gate 62 and rails 58 of bin 60 to vertically slidably mount gate 62 facewise adjacent bin 50 for upward and downward vertical movement with respect thereto. Slides 74 may comprise typical bearing-type slides such as drawer slides, for example.

Motor 76, shown herein as a bi-directional electric motor, is mounted to upper member 64 and includes drive shaft 78 extending therefrom and having opposite ends respectively received in bearing blocks 80 attached at each end of upper member 64. Gears 82 are attached at opposite ends of drive shaft 78 which extend externally of bearing blocks 80, and engage racks 60 of rails 58. In this manner, motor 76 is operable in a forward direction to drive gears 82 along racks 60 to lower gate 62 with respect to bin 50, and is operable in a reverse direction to and in a reverse direction to drive gears 82 along racks 60 to raise gate 62 with respect to bin 50. Alternatively, motor 76 may be mounted elsewhere within housing 22 and may drive gate 62 via a belt or chain drive, for example.

Gate switch 84 is disposed within opening 86 in cross plate 66 of gate 62, and projects slightly above upper surface 88 of cross plate 66. As described in further detail below, gate switch 84 is a contact or weight-sensitive switch which is operable upon contact with a newspaper passing over upper surface 88 of cross plate 66 and through discharge portion 72 of gate 62.

Figure 12:
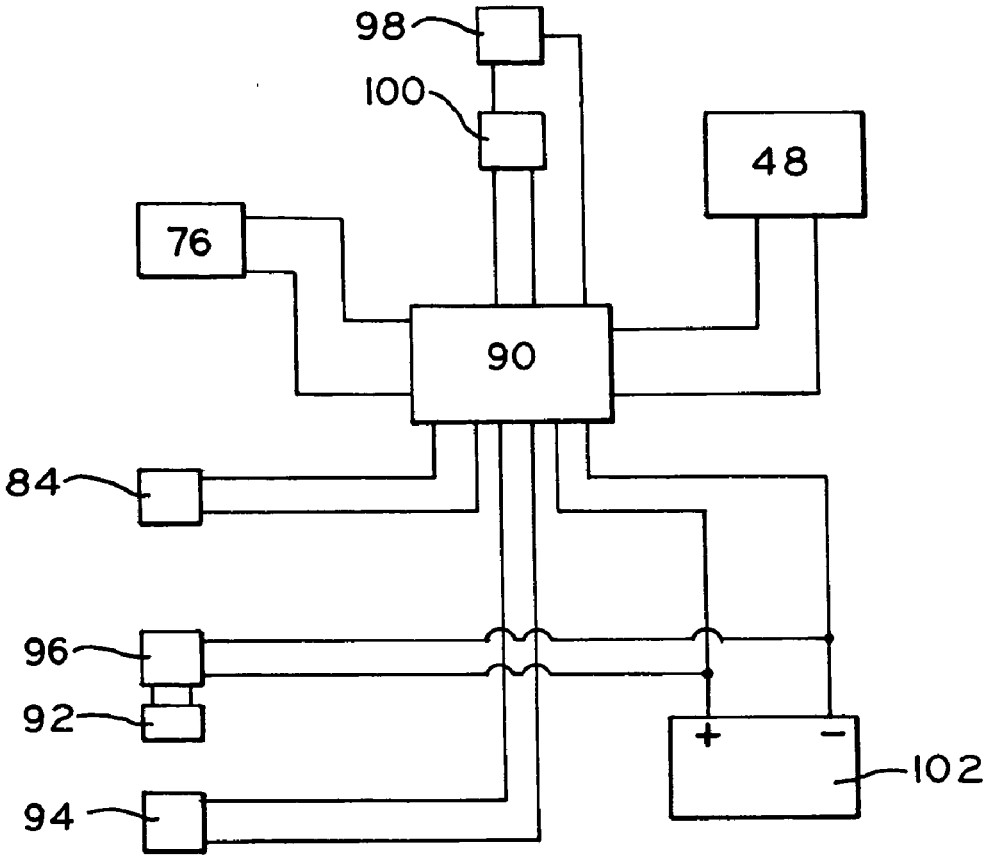
FIG. 12 is a schematic view of the electrical components of the machine.

Referring to FIG. 2 as well as the schematic view of FIG. 12, the various electrical components of vending machine 20 are shown. Control module 90 is the hub of the electrical components of machine 20, and may comprise any suitable commercially available programmable logic controller, for example. Control module 90 is electrically connected through various lines to coin acceptor module 48, solenoid 92, motor 76, switch 84, upper travel switch 94, lower travel switch 96, and first and second push button actuators 98 and 100. Battery 102 (FIG. 12), which may be a disposable or rechargeable battery, provides electrical power to the powered components of vending machine 20, such as control module 90, coin acceptor module 48, motor 76, and solenoid 92.

With respect to FIGS. 2–4 and 5A–5C, operation of vending machine 20 through a typical vending cycle will now be explained. When newspapers are stacked within bin 50, the newspapers are retained therein by abutment with side members 68 of gate 62. Normally, cross plate 66 and discharge portion 72 of gate 62 are disposed a distance above the uppermost newspaper in the stack. In this manner, the uppermost newspaper is prevented from passing through discharge portion 72 of gate 62 even if vending machine 20 is shaken, jostled, or tilted.

Figure 5C:
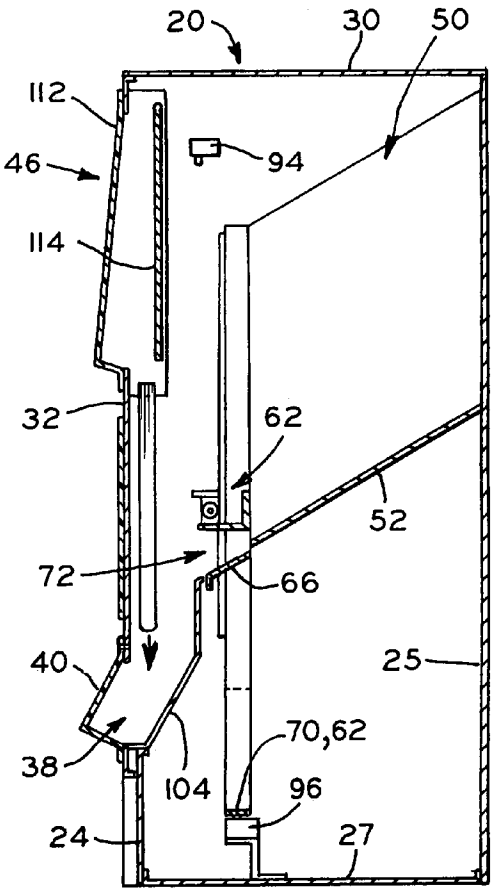
FIG. 5C is a side view of the storage bin and gate, the gate disposed at a furthest extent of downward travel and contacting a downward travel switch.
Figure 5B:
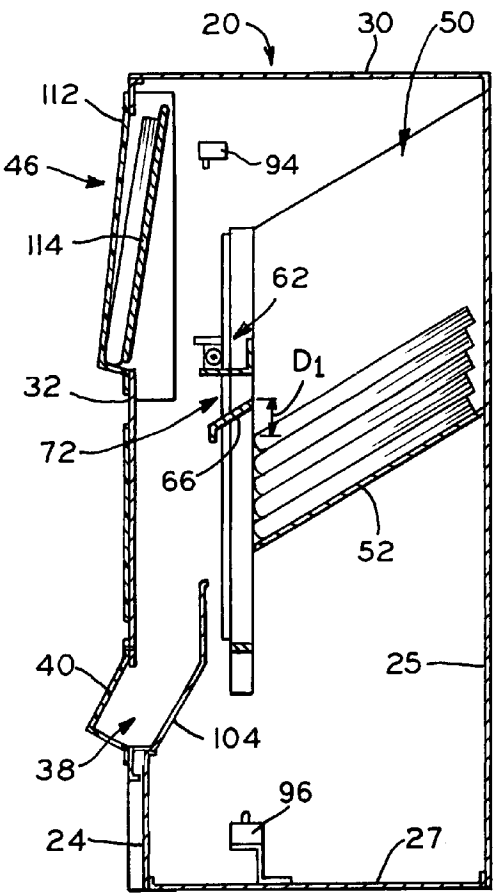
FIG. 5B is a side view of the storage bin and gate, the gate raising to prevent passage of a subsequent newspaper therethrough.
Figure 5A:
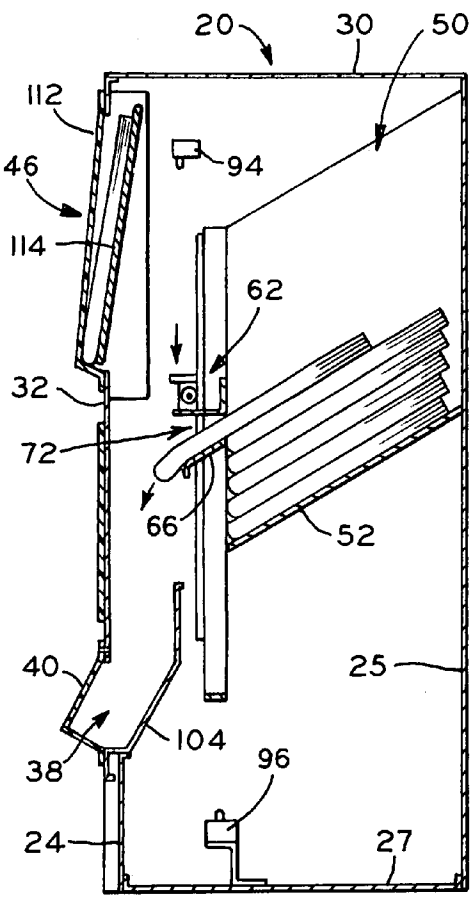
FIG. 5A is a side view of the storage bin and gate, the gate lowering to a position wherein a newspaper may pass through the gate.

Upon insertion of a proper coin total within coin acceptor module 48 by a purchaser, control module 90 initiates operation of motor 76 in a forward direction to begin lowering gate 62 with respect to bin 50 in which the newspapers are contained. When discharge portion 72 of gate 62 is aligned with an uppermost newspaper in the stack, with upper surface 88 of cross plate 66 just under the forward edge of the uppermost newspaper, the newspaper slides by gravity off of the stack and through discharge portion 72 of gate 62, as shown in FIG. 5A. Thereafter, the newspaper falls by gravity toward ramp 104 on the rear side of door 32, which guides the newspaper toward discharge opening 38, where same may be removed from machine 20 by the purchaser.

Concurrently, as the newspaper slides across upper surface 88 of cross plate 66 of gate 62, the newspaper contacts gate switch 84 and actuates same. Actuation of gate switch 84 causes control module 90 to initiate the operation of motor 76 in a reverse direction, after a very brief pause to allow the newspaper to pass completely through discharge portion 72 of gate 62. Control module operates motor 76 in the reverse direction to raise cross plate 66 of gate 62 a predetermined travel distance $D_1$, shown in FIGS. 5B and 9E, before stopping motor 76. In this manner, cross plate 66 and discharge portion 72 of gate 62 are raised above the next uppermost newspaper in the stack, such that gate 62 blocks the next uppermost newspaper in the stack and prevents same from passing through discharge portion 72 of gate 62. In particular, the distance $D_1$ which cross plate 66 of gate 72 is raised above the next uppermost newspaper in the stack is of a sufficient degree such that even if vending machine 20 is shaken, jostled or tilted, the uppermost newspaper will not pass through discharge portion 72 of gate 62. Typically, distance $D_1$ is between about 0.25 inches to about 3.0 inches or more. In this raised position, gate 62 is properly positioned for beginning another vending cycle.

Advantageously, gate switch 84 is thus responsive to the actual passing of a newspaper through discharge portion 72 of gate 62 to initiate reverse operation of motor 76 and the raising of gate 62. If the newspapers in bin 50 are relatively thin, gate 62 will travel downwardly a lesser extent before a newspaper is vended and gate 62 is raised. If, however, the newspapers in bin 50 are relatively thick, gate 62 will travel downwardly a greater extent before a newspaper is vended and gate 62 is raised. Thus, the vending mechanism of vending machine 20 is automatically sensitive to the thickness of the newspapers within bin 50, such that vending machine 20 does not need to be calibrated based upon the particular thickness of the newspapers, which often varies from day to day or throughout a week.

Figure 8:
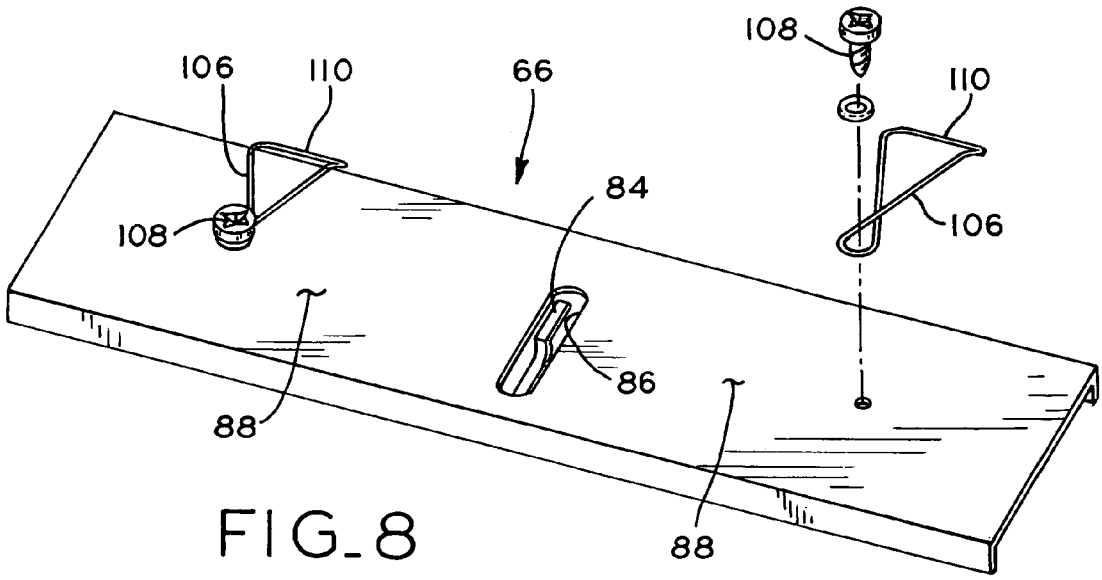
FIG. 8 is a perspective view of the cross plate of the gate, with a spring arm according to a first embodiment exploded therefrom.
Figure 9A:
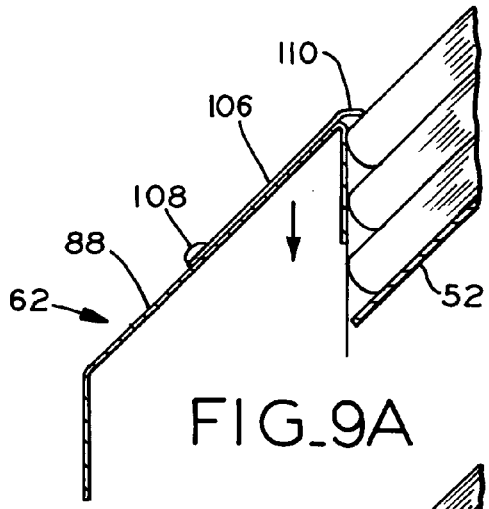
FIGS. 9A–9E are sequential views of the cross plate of the gate through a cycle of travel of the gate, showing the operation of the spring arms of the first embodiment.
Figure 9D:
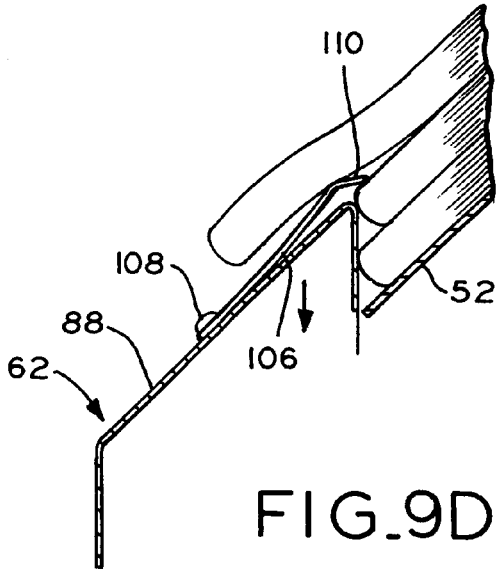
Figure 9B:
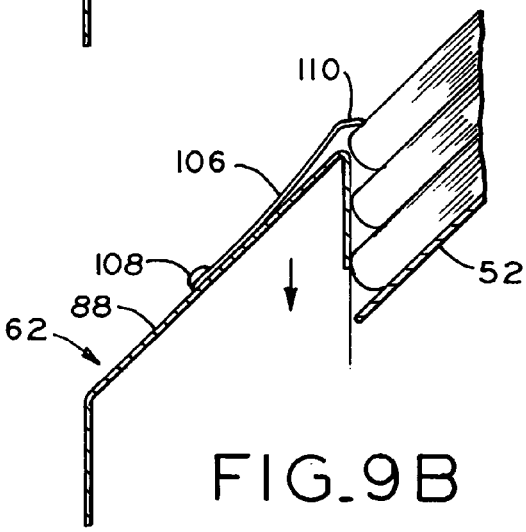
Figure 9E:
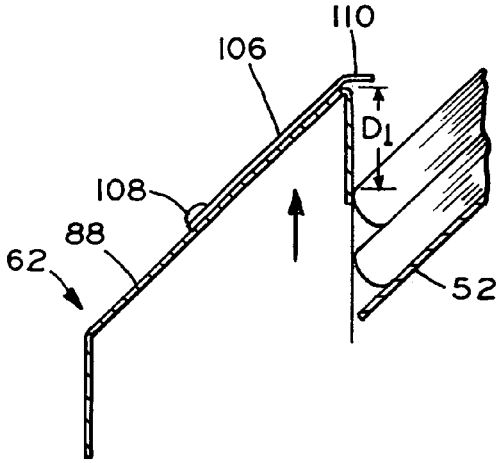
Figure 9C:
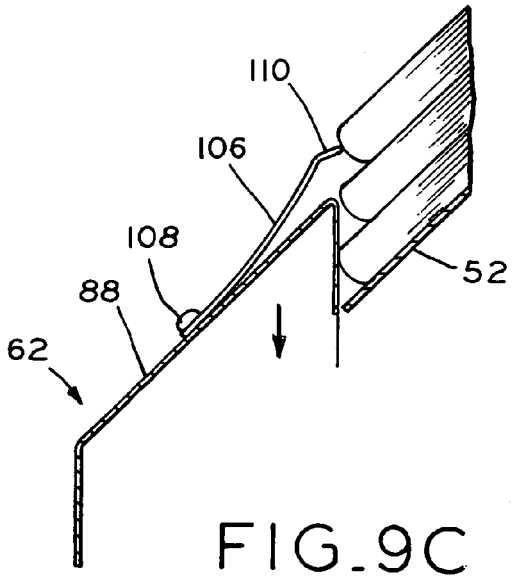

Referring to FIGS. 8 and 9A–9E, springs 106 are shown according to a first embodiment, which are optionally attached to cross plate 66 of gate 62 to aid in retaining newspapers within bin 50 and dispensing only a single newspaper at one time. As shown in FIG. 8, springs 106 are attached to cross plate 66 of gate 62 using suitable fasteners 108, such as screws, and include end portions 110 for selectively engaging newspapers, as described below with reference to FIGS. 9A–9E. Normally, as shown in FIG. 9A, springs 106 contact the uppermost newspaper in the stack of newspapers within bin 50. Upon lowering of gate 62 to vend the uppermost newspaper as described above, end portions 110 of springs 106 are initially deflected upwardly by contact with the uppermost newspaper from the position shown in FIG. 9A to that shown in FIG. 9B. As end portions 110 of springs 106 are deflected upwardly, the effective length of springs 106 is thereby reduced, such that end portions 110 of springs 106 eventually pass beneath the uppermost newspaper in the stack and engage and retain the next lower newspaper in the stack, as shown in FIGS. 9C and 9D. Thereupon, as shown in FIG. 9D, the uppermost newspaper may slide over springs 106 and out of vending machine 20 as described above. After the uppermost newspaper in the stack is vended, motor 76 reverses direction as described above to raise gate 62 above the new uppermost newspaper in the stack, as shown in FIG. 9E, such that gate 62 retains the new uppermost newspaper within bin 50.

Figure 10:
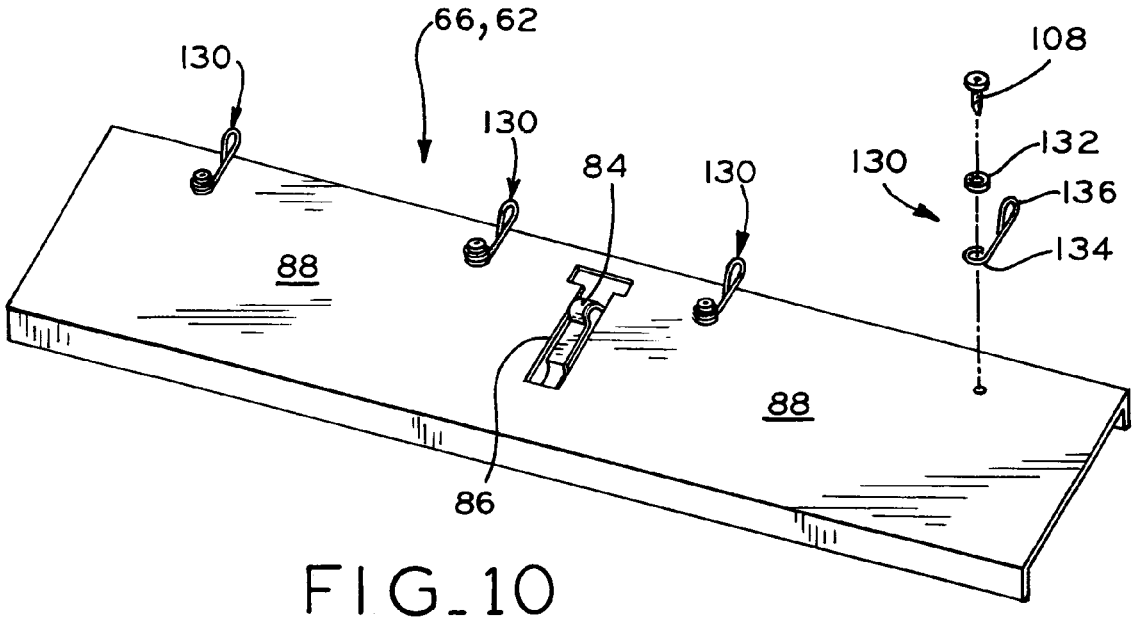
FIG. 10 is a perspective view of the cross plate of the gate, with a spring arm according to a second embodiment exploded therefrom.

Referring to FIGS. 10 and 11A–11E, springs 130 are shown according to a second embodiment which, similar to springs 106, are optionally attached to cross plate 66 of gate 62 to aid in retaining newspapers within bin 50 and dispensing only a single newspaper at one time. Referring to FIG. 10, springs 130 each comprise a section of 15 GA music wire having a diameter of 0.035 inches. However, the particular size of springs 130 may vary, for example, thinner music wire will provide less resistance to deflection and thicker music wire will provide more resistance to deflection. The number of springs 130 attached to cross plate 66 may vary between one to four springs 130 or more. Springs 130 are attached to cross plate 66 of gate 62 using suitable fasteners 108, such as screws or rivets, along with washers 132, such that loop end portions 134 of springs 130 are captured between cross plate 66 and washers 132. Springs 130 each include end portions 136 for selectively engaging newspapers, as described below with reference to FIGS. 11A–11E.

Figure 11A:
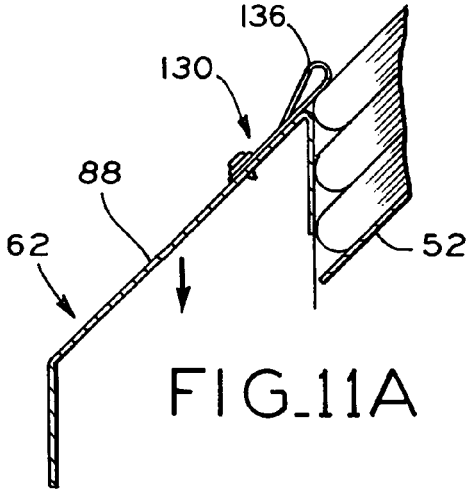
FIGS. 11A–11E are sequential views of the cross plate of the gate through a cycle of travel of the gate, showing the operation of the spring arms of the second embodiment.
Figure 11D:
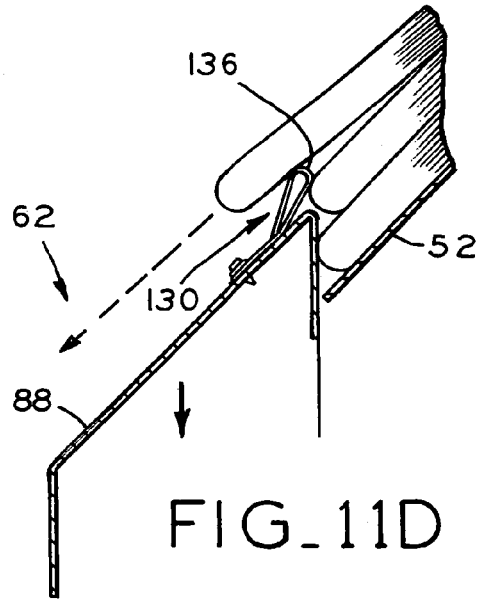
Figure 11B:
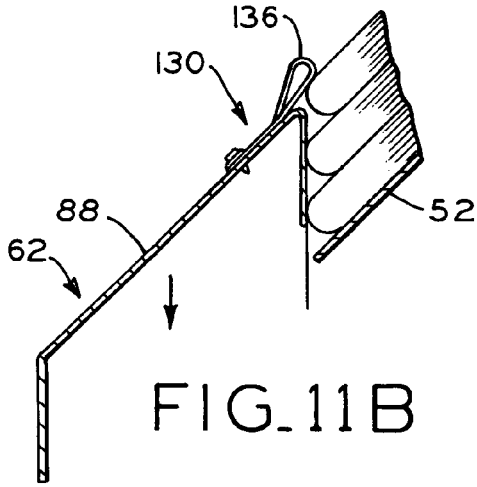
Figure 11E:
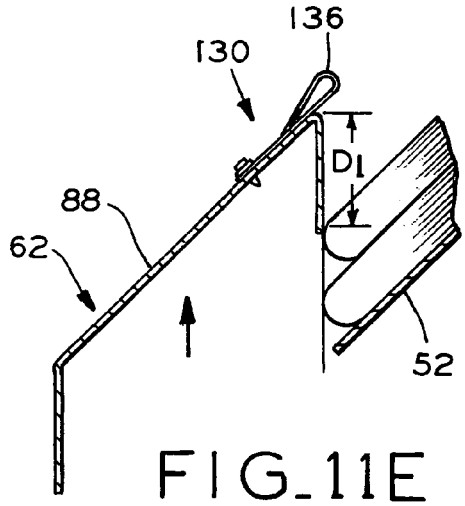
Figure 11C:
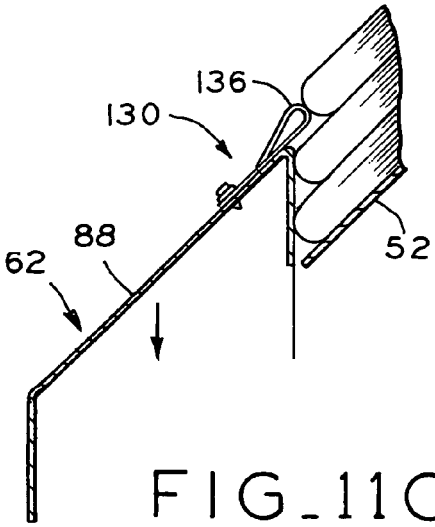

Normally, as shown in FIG. 11A, springs 130 contact the uppermost newspaper in the stack of newspapers within bin 50. Upon lowering of gate 62 to vend the uppermost newspaper as described above, end portions 136 of springs 130 are initially deflected slightly upwardly by contact with the uppermost newspaper from the position shown in FIG. 11A to that shown in FIG. 11B. As end portions 136 of springs 130 are deflected upwardly, the effective length of springs 130 is thereby reduced, such that end portions 136 of springs 130 eventually pass beneath the uppermost newspaper in the stack and engage and retain the next lower newspaper in the stack, as shown in FIGS. 11C and 11D. Thereupon, as shown in FIG. 11D, the uppermost newspaper may slide over springs 130 and out of vending machine 20 as described above. After the uppermost newspaper in the stack is vended, motor 76 reverses as described above to raise gate 62 above the new uppermost newspaper in the stack, as shown in FIG. 11E, such that gate 62 retains the new uppermost newspaper within bin 50. It has been determined that the use of springs 130 enable accurate dispensing of newspapers or other items having a thickness as small as 1/16 of an inch or less. Further, springs 130 substantially resist deflection, such that springs 130 also aid in dispensing much thicker, heavier newspapers or other items.

Vending of newspapers continues in the above manner until the last newspaper within bin 50 is vended and bin 50 is empty. As shown in FIG. 2, even when bin 50 is empty, a purchaser may still view the display newspaper in display area 46 of vending machine 20. With reference to FIG. 5C, if a purchaser deposits a proper coin total within coin acceptor module 48 when bin 50 is empty, gate 62 will move downwardly to contact lower travel switch 94 and actuate vending of the display newspaper in display area 46 as follows.

Figure 6:
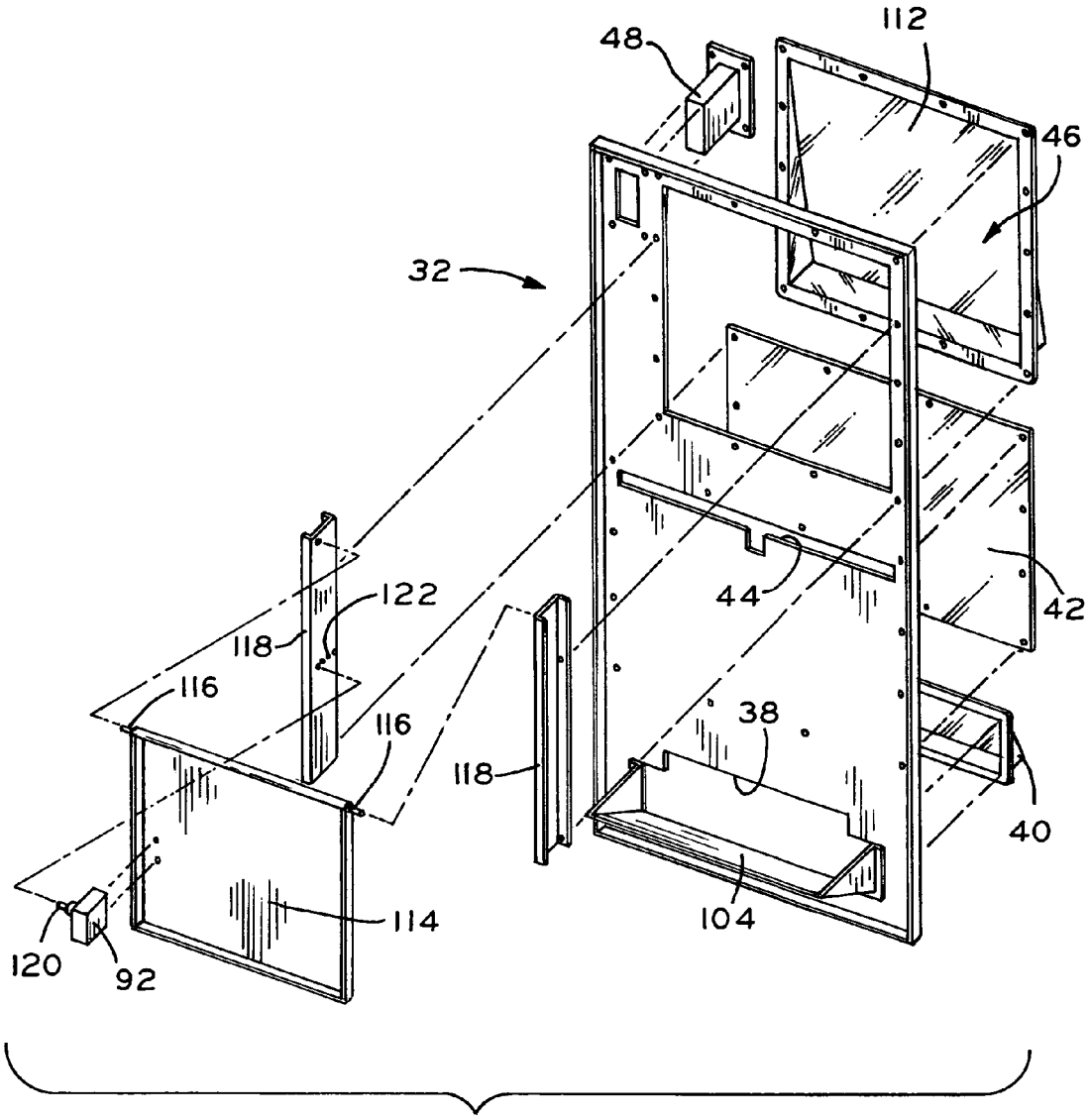
FIG. 6 is a rear exploded view of the door of the machine, showing components of the door and the display area.
Figure 7:
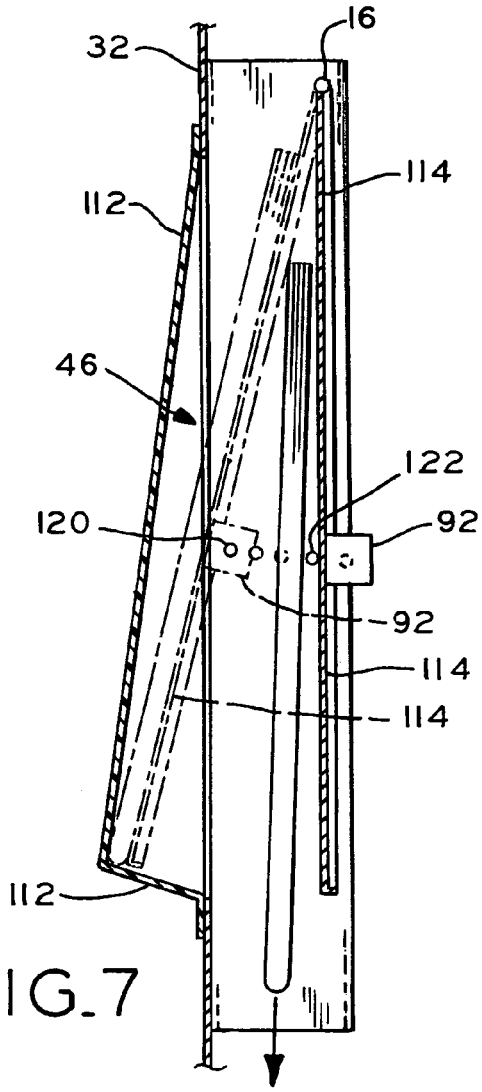
FIG. 7 is a side view of the display area, showing retention of the newspaper by the trap door in ghost lines and the release of the trap door and vending of the display newspaper in solid lines.

With reference to FIGS. 6 and 7, display area 46 of door 32 includes cover 112 made of a transparent plastic material to enable viewing of a display newspaper therethrough. Trap door 114 includes pivot rod 116 having opposite ends pivotally attached to a pair of frame elements 118 behind door 32, such that trap door is pivotally or swingably mounted behind door 32. Solenoid 92 is mounted to the rear side of trap door 114, and includes a retractable pin 120 which normally extends from solenoid and is received within one of a plurality of holes 122 in one of frame elements 118 to retain trap door 114 in an angled position from vertical. In this manner, as shown in FIG. 7, trap door 114 retains the display newspaper within display area 46, and the display newspaper may be viewed externally of vending machine 20 by a purchaser.

Upon actuation of lower travel switch 94 by gate 62, control module 90 electrically connects battery 102 to solenoid 120 to energize solenoid 120. Energization of solenoid 120 retracts pin 122 within solenoid 120 and releases trap door 114, such that trap door 114 may fall by gravity to a vertical position to release the display newspaper. In particular, upon retraction of pin 122, the weight of solenoid 120 and the weight of the display newspaper cause trap door 114 to swing by gravity rapidly to a vertical position, as shown in ghost lines in FIG. 7. The display newspaper falls downwardly toward ramp 104 behind door 32 and into discharge opening 38 of vending machine 20 where same may be retrieved by the purchaser.

Trap door 114 may include a suitable message such as "empty" on its front side which is visible through cover 112 of display area 46 to indicate to potential purchasers that the supply of newspapers within vending machine 20 is temporarily exhausted. Additionally, upon actuation of solenoid 92, control module 90 may optionally temporarily deactivate coin acceptor module 48 such that if coins are thereafter inserted into coin acceptor module 48, the coins are immediately returned.

To load newspapers within vending machine 20, an operator inserts a key into keyhole 36 in door 32 and opens door 32 as shown in FIG. 2. If gate 62 is in its lowermost position, the operator may depress first push button actuator 98 on control module 90 to cause motor 76 to raise gate 62 toward its uppermost position. Thereafter, the operator may load newspapers into bin 50 either through the space between side members 68 of gate 62, or by feeding newspapers into bin 50 over upper member 64 of gate 62. During the loading procedure, the operator may press first or second push button actuators 98 and 100 on control module 90 as necessary to raise and lower gate 62, respectively. After newspapers have been loaded into bin 50, the operator moves gate 62 into a suitable position above the topmost newspaper using first or second push button actuators 98 and 100. Notably, the precise positioning of gate 62 at this time is not critical, so long as cross plate 66 of gate 62 is above the uppermost newspaper in bin 50. As described above, during a vending cycle, motor 76 will move gate 62 downwardly until a newspaper actuates gate switch 84 upon vending of same, whereupon motor 76 will reverse direction to raise gate 62.

After loading bin 50, the operator may place a display newspaper within display area 46 and engage pin 122 of solenoid 92 with one of the plurality of holes 122 in frame element 118 of door 32 to retain the display newspaper within display area 46. Thereafter, the operator may reset the coin total on coin acceptor module 46 if necessary, and then close and lock door 32. Thereafter, vending machine 20 is ready to dispense newspapers in the manner described above.

While this invention has been described as having a preferred design, the present invention can be further modified within the spirit and scope of this disclosure. This application is therefore intended to cover any variations, uses, or adaptations of the invention using its general principles. Further, this application is intended to cover such departures from the present disclosure as come within known or customary practice in the art to which this invention pertains and which fall within the limits of the appended claims.

What is claimed is:

1. A vending machine, comprising:

a housing having a discharge opening therein;

a storage area within said housing, said storage area having an inclined surface upon which a plurality of articles may be stacked, said storage area in dispensing communication with said discharge opening;

a gate disposed adjacent said storage area, said gate movable bi-directionally with respect to said storage area;

a bi-directional drive device drivingly coupled to said gate; whereby when said drive device is initially operable to move said gate in a first direction an article may pass said gate from said storage area toward said discharge opening, and when said drive device is subsequently operable to move said gate in a second direction opposite said first direction additional articles may not pass said gate; and a drive device reverse actuation switch associated with said gate, said switch responsive to an article passing said gate; whereby when said switch is actuated by a passing article, said drive device is caused to move said gate in said second direction.

2. The vending machine of claim 1, wherein said gate is movable substantially vertically with respect to said storage area, and said drive device is initially operable to lower said gate and subsequently operable to raise said gate.

3. The vending machine of claim 1, further comprising a user interface connected to said drive device, said user interface operable to initiate operation of said drive device to move said gate in said first direction.

4. The vending machine of claim 1, wherein said storage area is a bin including said inclined bottom surface from which a pair of side walls and a rear wall upwardly extend, said gate disposed adjacent said side walls and opposite said rear wall.

5. The vending machine of claim 1, wherein said gate includes an upper surface over which articles may pass, said switch projecting from said upper surface whereby said switch is contacted by articles passing over said upper surface.

6. The vending machine of claim 1, wherein said gate includes at least one spring arm extending at least partially within said storage area, said spring arm positioned to contact and releasably retain an uppermost article within said storage area.

7. The vending machine of claim 1, wherein said drive device comprises an electric motor operable in a forward direction to move said gate in said first direction and operable in a reverse direction to move said gate in said second direction, and said switch comprises a contact switch actuator and control module.

8. The vending machine of claim 2, wherein said housing further comprises:

a display area containing a single article therein;

a limit switch operable by said gate upon a lowermost extent of travel of said gate to release said single article from said display area toward said discharge opening.

9. A vending machine, comprising:

a housing having a wall with a discharge opening therein;

a storage area within said housing, said storage area having a bottom surface with a stack of articles thereon, said bottom surface inclined in an upward direction from said wall;

a gate disposed adjacent said storage area and having a discharge portion dimensioned for passage of a said article therethrough, said gate movable downwardly and upwardly with respect to said storage area;

a motor drivingly coupled to said gate, said motor initially operable in a forward direction to move said gate downwardly to align said discharge portion with an uppermost article in said stack, said motor subsequently operable in a reverse direction to move said gate upwardly such that said discharge portion is not aligned with any remaining articles in said stack; and a switch associated with said discharge portion of said gate, said switch responsive to an article passing said discharge portion to initiate operation of said motor in said reverse direction;

whereby when said discharge portion is aligned with said uppermost article in said stack, said uppermost article may pass through said discharge portion toward said discharge opening and actuate said switch, and when said discharge portion is not aligned with any remaining articles in said stack, said remaining articles are prevented from passing said discharge portion.

10. The vending machine of claim 9, further comprising a user interface connected to said motor, said user interface operable to initiate operation of said motor in said forward direction.

11. The vending machine of claim 9, wherein said gate includes at least one spring arm extending at least partially within said storage area, said spring arm contacting and releasably retaining an uppermost article within said stack.

12. The vending machine of claim 9, wherein said discharge portion of said gate includes an upper surface over which articles may pass, said switch projecting from said upper surface whereby said switch is contacted by articles passing over said upper surface.

13. The vending machine of claim 9, wherein said housing further comprises:

a display area containing a single said article therein;

a limit switch operable by said gate upon a lowermost extent of travel of said gate corresponding to an absence of articles within said storage area to release said single article from said display area toward said discharge opening.

14. A vending machine, comprising:

a housing having a wall with a discharge opening therein;

a storage area within said housing, said storage area having a bottom surface upon which a plurality of articles may be stacked, said bottom surface inclined upwardly with respect to said discharge opening;

a gate disposed adjacent said storage area, said gate movable vertically with respect to said storage area;

a drive device coupled to said gate and operable to lower said gate such that an article may pass said gate toward said discharge opening, and further operable to raise said gate such that articles are prevented from passing said gate;

user-responsive means for initially causing said drive device to lower said gate sufficiently to allow an article to pass said gate toward said discharge opening; and article-responsive means associated with said gate for subsequently causing said drive device to raise said gate sufficiently to prevent further articles from passing said gate.

15. The vending machine of claim 14, wherein said housing further comprises:

a display area containing a single article therein;

release means operable by said gate upon a lowermost extent of travel of said gate for releasing said single article from said display area toward said discharge opening.

16. The vending machine of claim 14, wherein said gate includes an upper surface over which articles may pass, and said article-responsive means comprises a switch projecting from said upper surface whereby said switch is contacted by articles passing over said upper surface.

17. The vending machine of claim 14, wherein said user-responsive means comprises a coin acceptor and a controller connected to said drive device.

18. The vending machine of claim 14, wherein said gate includes means for contacting and releasably retaining an uppermost article within said storage area.

19. A method of vending an article from a vending machine, comprising the steps of:

accepting presentation of payment from a purchaser;

moving first a gate within the vending machine into operable alignment with an article disposed upon an inclined surface within the vending machine;

allowing the article to pass the gate and thereby actuating a switch associated with the gate; and moving second the gate responsive to actuation of the switch into blocking relationship with at least one other article within the vending machine.

20. The method of claim 19, wherein said first moving step comprises moving the gate in a first direction and said second moving step comprises moving the gate in a second direction opposite the first direction.

21. The method of claim 19, wherein said first moving step comprises lowering the gate in a vertical direction and said second moving step comprises raising the gate in a vertical direction.

22. The method of claim 19, wherein said allowing step further comprises allowing the article to slide by gravity across an upper surface of the gate while actuating a switch disposed within the upper surface of the gate by contact with the article.

23. The method of claim 19, wherein said first and second moving steps each further comprise actuating a bi-directional drive device coupled to the gate.

* * * * *